United States Patent [19]

Emerson

[11] Patent Number: 4,854,605

[45] Date of Patent: Aug. 8, 1989

[54] SKI BINDING FOR MOUNTAIN SKIING

[76] Inventor: Kenneth D. Emerson, 3205 395 North, Carson City, Nev. 89701

[21] Appl. No.: 213,118

[22] Filed: Jun. 29, 1988

[51] Int. Cl.[4] ..... A63C 9/08

[52] U.S. Cl. ..... 280/615

[58] Field of Search ..... 280/614, 615, 611, 607

[56] References Cited

U.S. PATENT DOCUMENTS

| | | | |
|---|---|---|---|
| 4,178,013 | 12/1979 | Bataille | 280/618 |

FOREIGN PATENT DOCUMENTS

| | | | |
|---|---|---|---|
| 81907 | of 1895 | Fed. Rep. of Germany | 280/615 |
| 2255535 | 5/1974 | Fed. Rep. of Germany | 280/614 |
| 2714853 | 10/1978 | Fed. Rep. of Germany | 280/614 |
| 28871 | 6/1918 | Norway | 280/615 |
| 67729 | 4/1944 | Norway | 280/615 |
| 115026 | 9/1945 | Sweden | 280/615 |

*Primary Examiner*—Charles A. Marmor
*Assistant Examiner*—Michael Mar
*Attorney, Agent, or Firm*—Poms, Smith, Lande & Rose

[57] ABSTRACT

A ski binding for mountain and/or cross country skiing in which a ski member is provided with a fixed upstanding frame structure providing a pivot pin support for pivotal mounting of a cradle member or boot platform which receives a ski boot, the cradle member having a pivot pin releasably supported from the frame structure at a location above and approximately in the same vertical planar zone of the ball of the foot in a ski boot when the boot and cradle member are assembled with the fixed frame structure. The pivot pin is spaced a sufficient distance above the ski surface so that the ski boot may pivot thereabout with sufficient clearance to accommodate the motion of the boot relative to the ski during skiing.

12 Claims, 4 Drawing Sheets

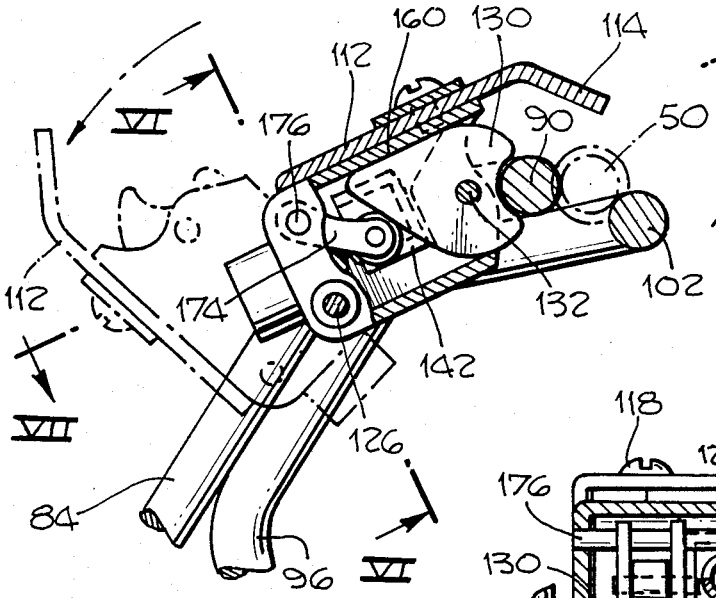
Fig. 5.
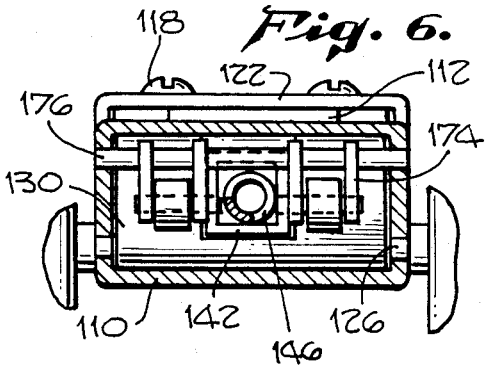
Fig. 6.
Fig. 10.
PRIOR ART
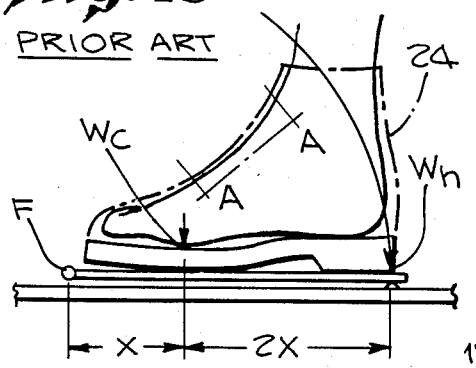
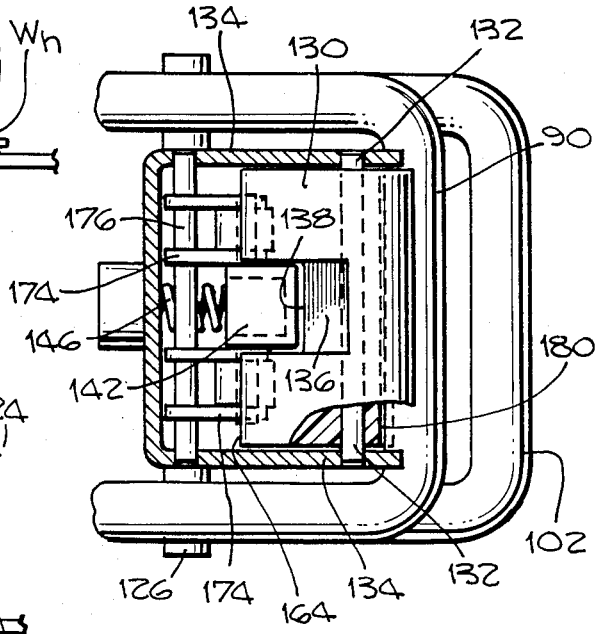
Fig. 7.
Fig. 11.
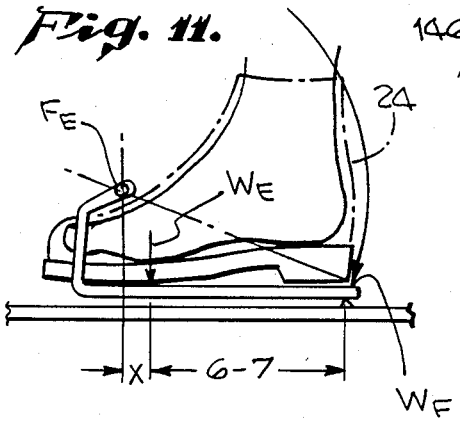

SKI BINDING FOR MOUNTAIN SKIING

BACKGROUND OF THE INVENTION

This invention relates to a ski binding for use in mountain and/or cross country skiing. It should be noted that ski bindings for such mountaineering and cross country uses differ substantially from ski bindings used for downhill skiing in which the ski boot is held in fixed relation at both heel and toe to the ski member. In cross country and mountaineering skiing, the ski binding is of a different type in that the ski boot is required to have pivotal movement in relation to the ski member so that the ski boot and foot therein may propel the ski forwardly. Further, ski bindings for mountaineering purposes are different from cross country ski bindings in that mountaineering ski binding is used with rigid soled boots which are necessary for rock climbing, peak scaling, and ice climbing as with crampons. Cross country conventional ski boots are usually flexibly soled and will bend with the foot, but are useful only for cross country skiing and for walking. Mountaineering ski bindings used for high mountain travel must function with a skier who may carry heavy loads over steep up and down hill terrain. This requirement necessitates a means for lifting the heel from the ski to achieve forward motion in either "walking" or climbing.

The heel lifting function of a mountaineering ski binding has been facilitated by a hinge or pivot provided at the toe of the boot just slightly forwardly of the boot sole. The hinge may include a forward section which is secured to the top surface of the ski and an aft section which may comprise a long plate to which the boot is attached in a variety of ways. These bindings usually include some type of release mechanism for disengagement in the event of undue stress, as in a fall, and also include a device to lock the aft section of the plate or heel in downward position for added control in descending a hill. Such prior proposed existing devices have disadvantages in which the location of the pivot axis of the hinge forwardly of the toe of the boot causes a great deal of friction between the skier's heel and heel cup of the boot which, after many forward motions or strides, results in serious blisters of the heels of the skier. Attempts to compensate for this condition include tying the boots tighter to reduce the relative movement between the heel and the boot. Such tight bindings reduces circulation and in some circumstances invites frost bite. Another disadvantage of the prior proposed bindings relates to the motions required to lift the heel for forward propulsion, such motions being not biodynamically efficient and which lead to fatigue and sore calf muscles.

An example of such prior proposed devices is disclosed in U.S. Pat. No. 4,178,013 which is directed toward providing a ski binding to eliminate use of a rigid ski boot and to enable the skier to wear non-rigid boots. Ski bindings having pivotal axes forwardly of the toe of the ski boot are shown in Swedish patent No. 115,026, and Norwegian patent No. 28,871 which shows a ski binding device at the front portion of the boot for providing a pivot axis at the sole of the boot and in close relation to the top surface of a ski member Norwegian patent No. 67,729 shows a ski binding device having a pivot axis forwardly of the toe of the boot and having side links connected to the sole of the boot rearwardly of the toe of the boot.

In the conventional ski mountaineering binding used with a rigid soled boot, in order to step forward on one foot a force at the heel must be countered by an equal force located at an instep area due to the flexing of the boot material, compression of the socks, and flexing of the foot itself. As a result of this force relationship, the skier's heel within the boot will lift and rub against the inside surface of the boot heel cup causing blisters. The distribution of weight is such that most of the weight is at the fulcrum axis which, in the conventional mountaineering binding, occurs just forwardly of the front toe portion of the sole.

SUMMARY OF INVENTION

The present invention relates to a novel arrangement of a ski binding for use in mountaineering and/or cross country skiing which differs from the prior proposed ski binding devices mentioned above. In the ski binding device contemplated by this invention, the pivotal point of the binding is at a position only slightly forwardly of and above the ball of a foot positioned in a ski boot. This location of the binding pivot point modifies and alters the force vectors caused by the skier's weight so that when weight is put on the ball of the foot for forward propulsion, the major part of the skier's weight and load is carried by the fulcrum or pivot point which is located above the ski surface and above the rear toe portion of the ski boot. The weight distribution provided by the ski binding of this invention does not transfer weight to the toe of the boot or heel of the boot except for nominal or a small proportion of the weight at the heel. This weight distribution, achieved by the location of the fulcrum pivot of the present invention, more closely approximates the natural dynamics of walking where the ball of the foot carries the weight of the person walking through most of the forward propulsion of the stride. By elevating the pivotal point above the ball of the foot and over the boot, sufficient arc diameter is provided so that the boot may remain sufficiently close to the top surface of the ski to provide stability and yet not interfere with the ski through its range of motion.

The present invention contemplates a ski binding device in which this fulcrum pivot point location is achieved by providing a trapeze-like frame structure which is fixedly attached to the ski forwardly of the boot and arches upwardly and backwardly in the nature of a cantilever to provide a pivot support means positioned approximately over the ball of a foot. A cradle or boot platform structure is provided which carries a freely rotating transverse cylindrical pivot bushing and which partially straddles the trapeze frame structure and curves underneath the boot serving as a full length platform on which the boot is held secure. The cradle structure is proportioned to maintain a narrower width profile than that of the boot to prevent any binding interference or clipping during normal ski member bypassing in a forward locomotion mode or in a downhill skiing mode. The cradle structure includes means for securing the boot in the cradle by a resilient coil spring at the front end of the cradle and a longitudinally adjustable heel locking lever at the back end of the cradle structure. The invention contemplates a releasable lock mechanism to be provided on the trapeze frame structure for facilitating locked assembly of the trapeze frame structure and the cradle structure.

The present invention further contemplates a novel construction and arrangement of a ski binding useful for mountaineering skiing as well as cross country skiing in which the functioning of the ski binding is such that the formation of blisters on heels of a skier is eliminated or reduced to a minimum as compared to conventional ski bindings. The ski binder of this invention will permit looser lacings of the ski boots, reducing the possibility of frost bite and cold toes. Further, on long climbs in the mountains with heavy loads, the calf strain on the legs will be substantially reduced.

The invention contemplates that the ski binding device of the present invention when used with a rigid soled boot will substantially reduce the force necessary to lift the heel of the boot off the ski for forward movement. As a result movement of the skier's heel against the boot heel cup is significantly diminished. The location of the pivotal axis above and forwardly of the ball of the foot permits a more effective smoother rolling motion to be achieved with the foot while skiing. Load distribution on the ski binding of this invention, places a greater major weight on the fulcrum pivot point and a substantially reduced minimum weight at the heel.

It is a primary object of the present invention, therefore, to disclose and provide a ski binding of novel construction which obviates some disadvantages of prior proposed ski bindings and which facilitates forward locomotion and the carrying of heavy loads by a skier in mountain and cross country skiing.

An object of the present invention is to disclose a ski binding in which a cradle member which is attachable to a ski boot is hung from a pivot axis located above and slightly forwardly of the ball of a foot so as to effectively distribute forces for facilitating movement during skiing.

Another object of the present invention is to disclose and provide a ski binding in which a ski boot is positioned so that the heel of the boot may travel slightly rearwardly and upwardly relative to a pivotal axis in commencing a forward stride and in which the toe of the boot is adapted to be rotated about such axis with clearance for the sole of the boot with respect to the top surface of the ski member.

The invention particularly contemplates a ski binding for mountaineering uses in which a trapeze-like frame means is fixed to the ski member and provides a pivot pin support structure for receiving a pivot pin carried by a cradle-like structure which provides attachment to a ski boot.

The invention contemplates a novel releasable lock mechanism carried by the trapeze-like structure for releasably retaining the cradle means in assembly therewith.

Various other objects and advantages of the present invention will be readily apparent from the following description of the drawings in which an exemplary embodiment of the invention is shown.

In the Drawings

FIG. 5 is an enlarged sectional view taken in a plane indicated by the line V—V of FIG. 7.

FIG. 6 is a transverse sectional view taken in the plane indicated by line VI—VI of FIG. 5.

FIG. 7 is a transverse sectional view taken in the plane indicated by line VII—VII of FIG. 5.

FIG. 10 is a schematic line illustration of the relationship of the ball of the foot to the conventional pivot means for cross country or mountain skiing.

FIG. 11 is a schematic line illustration of the relationship of the ball of the foot to the pivotal axis of the ski binding of the present invention.

DETAILED DESCRIPTION OF THE INVENTION

Figure 1:
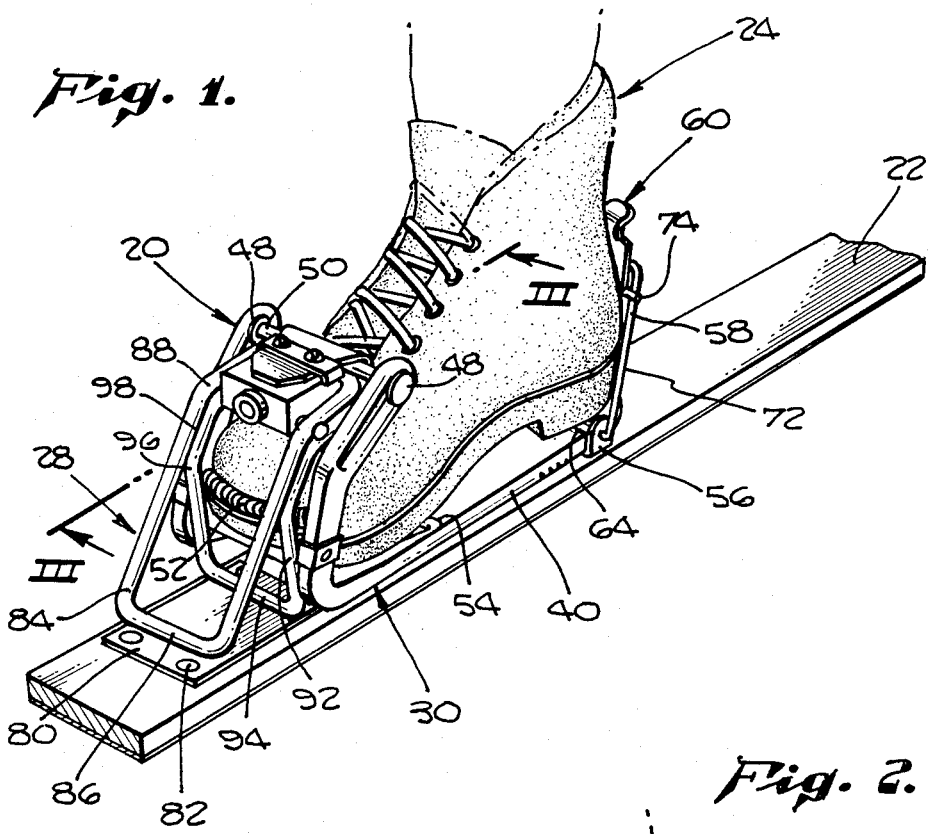
FIG. 1 is a left front perspective view of a ski binding device embodying the present invention, with a ski boot carried thereon, together with a fragmentary portion of an attached ski member.

In FIG. 1, a ski binding generally indicated at 20 is shown. Ski binding 20 is illustrated in relation to a small section of a ski member 22 which may be a conventional cross country or mountain ski design. Binding 20 secures a ski boot generally indicated at 24 which is releasably held within the ski binding. The bottom surface of ski boot 24 is held by the ski binding above and in spaced relation to the top surface 26 of the ski member 22.

Generally speaking, ski binding 20 comprises a trapeze-like frame structure or means generally indicated at 28, a cradle or boot platform means generally indicated at 30, a releasable lock means generally indicated at 32 for retaining the cradle means 30 in assembled relation with the fixed trapeze frame means 28; and a clamp means generally indicated at 34 for retaining the cradle means at the heel of the boot 24.

Figure 2:
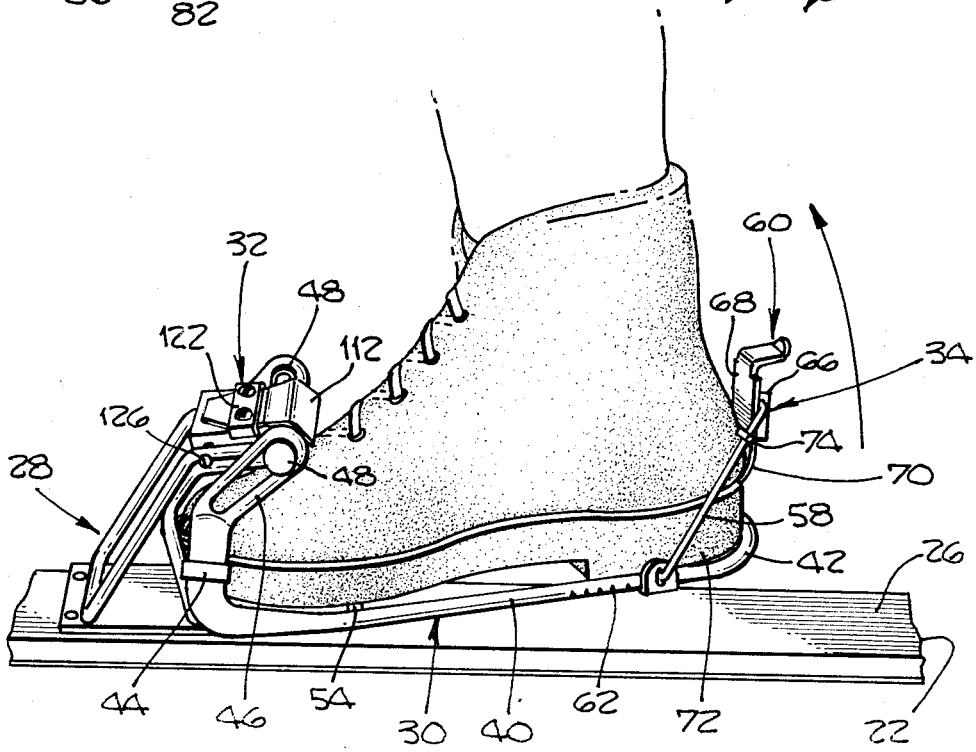
FIG. 2 is a side elevational view of the ski device of FIG. 1, with a cradle member of the device pivotally swung slightly upwardly from its lowermost or rest position.

The cradle or boot platform means 30 is adapted to support and hold the boot 24 in secured relation with the fixed trapeze frame means 28 and the ski member. As best seen in FIGS. 1 and 2, the cradle means 30 positions the sole of the boot above the top surface 26 of the ski member. Cradle means 30 in detail comprises a pair of spaced side members 40 joined at their rearward ends by a curved end portion 42 which generally conforms to the curvature of the heel of a boot. The forward ends of side members 40 terminate in upstanding support members 44 each of which include an upper rearwardly inclined end section 46. At the top of each end section 46 is provided a bushing 48 which supports a transverse axle or sleeved pivot pin 50. Intermediate the upstanding members 44 is provided a transverse coil spring 52 at a level which will engage the toe of a boot at or just above the front end of the sole of a ski boot to resiliently restrict forward displacement of the boot.

Intermediate ends of the side members 40 is provided a transverse reinforcing bar 54 against which the sole of the boot may contact at a point approximately at or slightly rearwardly of a position of the ball of a foot in the ski boot. Adjacent the rear ends of the cradle side members 40 may be provided a transverse adjustable bar means 56 which carries a bail 58 of a releasable heel clamp means 60. The rearward portions of side members 40 may be provided with a plurality of spaced notches 62 which cooperate with a protrusion (not shown) on the adjustable means 56 to permit longitudinal incremental adjustment of the heel clamp means 60 relative to the boot 24. Adjustable means 56 includes a transverse member 64 which supports the heel of the boot at a selected spaced distance from the top surface of the ski member.

The top end of bail 58 carries heel clamp means 60 which is pivotally mounted at 66 to permit swinging adjustment of a clamp member 68 into proper relationship with the boot heel. The lower portion 70 of clamp member 68 may be slightly curved forwardly to accommodate the curved contour of the boot heel. The bail 58 is pivotally connected at 72 to the transverse adjustable bar means 56 to provide pivotal movement for proper adjustment of clamp means 60 when the adjustable means 56 is changed from one of the positioning notches 62 to another set of notches depending upon the size of the ski boot. Sidewardly directed limit pins 74 pivotally mounted on clamp member 68 contact bail 58 to restrict movement of member 68 in a forward direction.

The trapeze frame structure or means 28 may comprise a bottom plate 80 fixed by suitable rivets or screws 82 to the top surface of the ski member 22. Upstanding frame members 84 may be welded at their bottom transverse leg 86 to the plate 80 and extend upwardly and incline rearwardly to terminate in slightly upwardly inclined end portions 88 which are connected by a transverse cylindrical end member 90. Rearwardly of frame members 84 is provided a second set of side frame members 92 interconnected by a transverse member 94 adjacent the bottom, said member 94 being secured as by welding to the plate 80. Frame members 92 are provided with an intermediate portions 96 inclined rearwardly in parallel relation with the forward set of side members 84 and may be welded thereto as at 98. The inclined intermediate portions 96 terminate in a further rearwardly inclined portion 100 (FIG. 3) which are joined by an end transverse cylindrical member 102 spaced forwardly of transverse end member 90 and in selected spaced downwardly inclined relationship therewith to provide a recess or space for partial reception of pivot pin 50 carried by the cradle means.

The rearward inclination of the fixed trapeze frame means 28 and the rearward inclination of the upstanding support members 46 of the cradle means permits pivot pin 50 of the cradle means to be lowered partially between transverse members 90 and 102 and to provide tangential intercontacts between the cylindrical surface of pin 50 and the cylindrical end members 90 and 102. Swinging of the cradle means about the pivotal support means and mounting provided by members 90 and 102 and pin 50 is free and unrestrained. The freeness of this pivotal connection at pivot pin 50 enhances the ease of pivoting the cradle means and the boot retained thereby about pivot axis 104 formed by pivot pin 50. To further facilitate this pivotal movement, pivot pin 50 may comprise an external sleeve 106 of anti-friction corrosion resistant material so that the cradle means will readily pivot on the fixed trapeze frame means 28.

In FIG. 1, it should be noted that the toe of the boot, when the cradle means and the boot are assembled with the fixed trapeze means 28, is received between upstanding cradle members 44 and is resiliently forwardly positioned by the resiliency of coil spring 52. Thus the boot, when positioned in the cradle means and the cradle means is hung from the fixed trapeze means, will be pivotally supported about pivot axis 104 formed by the pivot pin 50 above and rearwardly of the toe of the boot. The heel of the boot may be readily lifted away from the top surface of the ski member 22 as more particularly described hereafter.

An example of a releasable lock means 32 is illustrated in detail in FIGS. 3–9. Releasable lock means 32 comprises a housing 110 of a generally rectangular form and is adapted to be supported between the rearwardly directed end portions 88 of the trapeze means 28. Housing 110 carries a rearwardly extending clamp member 112 which is provided at its rearward clamping end with a downwardly inclined clamp end portion 114. Clamp member 112 includes a pair of elongated slots 116 through which may extend a pair of securement screws 118 to adjust the relative position of clamp member 112 with respect to the top wall 120 of the housing. A strap 122 overlying member 112 may be secured to the housing as by welding at ends thereof as at 124, FIG. 2. Housing 110 is pivotally mounted by a transverse pin 126 on the side members 88 adjacent the inclined side members 84.

Within housing 110 is provided a cam block 130 of ultra-high molecular weight polyethylene or like material having surfaces thereof machined to selected dimensions. Cam block 130 is mounted on a through shaft 132 carried by side walls 134 of housing 110. Cam block 130 includes a recessed central portion providing clearance for a biased spring cap 142.

Spring cap 142 may be polygonal in shape and is provided with one side open at 144 for reception of one end of a helical biasing spring 146. The inner end of spring 146 seats, as at 148, on the inner surface of the front wall of the cap. The opposite end of spring 146 seats as at 150 against a set screw 152 which is threaded within a nipple 154 on the back wall of housing 110 for adjusting the compression of the spring 146 and controlling the pressure exerted by a pair of cam rollers 170 against cam lobe surfaces 160, 162, 164 throughout the range of rotation of cam block 130.

Figure 3:
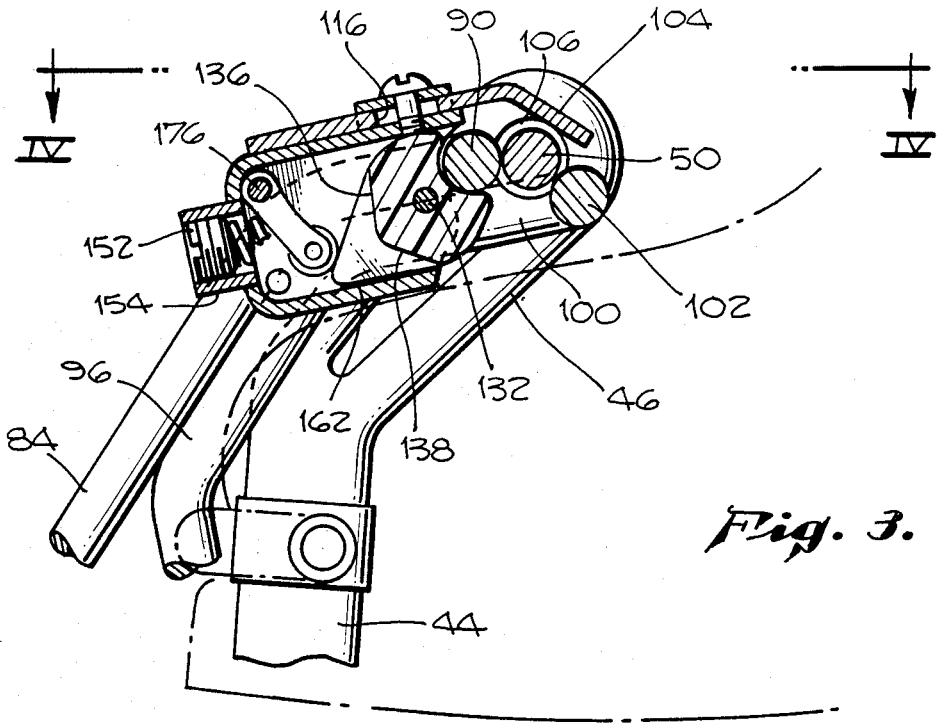
FIG. 3 is an enlarged fragmentary sectional view of the device shown in FIG. 1, the section being taken in a vertical plane indicated by line III—III of FIG. 1 with the releasable lock means in locked position.
Figure 4:
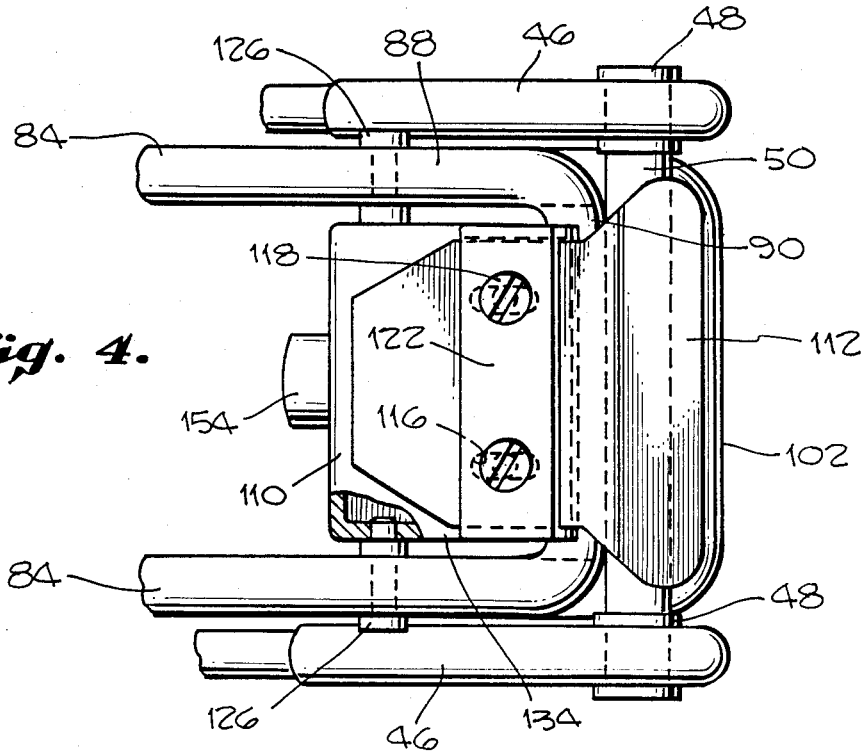
FIG. 4 is a plan view taken from the plane indicated by line IV—IV of FIG. 3.

Cam block 130 includes a teardrop cross sectional configuration on opposite sides of the central recessed portion. This teardrop cross section serves as a cam through its rotational arc about shaft 132, which works against cam roller 170, which swings in an arc defined by links 174. Links 174 are pivotally mounted for rotation about the axis of a through shaft 176, carried by housing 110. Cam rollers 170 are connected to spring cap 142 by means of stub shafts 172. The force of spring 146 through spring cap 142, stub shafts 172, and cam rollers 170, oppose rotation of cam block 130, the rollers 170 bearing against cam surfaces 160 in locked position (FIG. 3). When rotational forces of cam block 130 are sufficient to overcome the force of spring 146, cam rollers 170 will pass over cam lobe 164 of cam block 130 and bear against surfaces 162, maintaining a fully released clamping mechanism position.

Figures 8, 9:
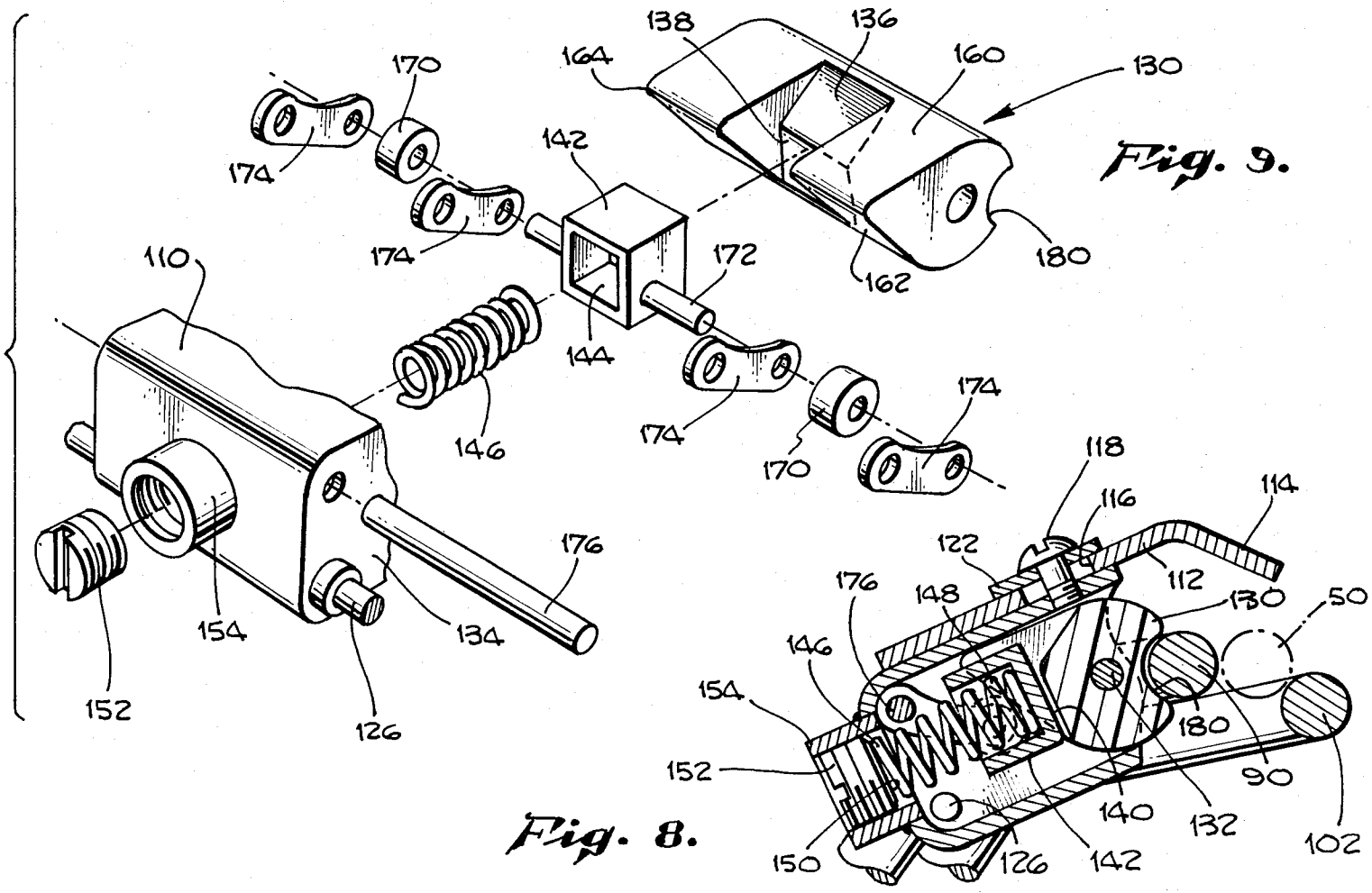
FIG. 8 is an enlarged sectional view taken in the plane indicated by line VIII—VIII of FIG. 7.
FIG. 9 is an exploded perspective view of the elements of the releasable lock means shown in FIGS. 6 and 7.

It will also be noted from FIGS. 9, 3, and 5 that the generally part cylindrical surface of the tear drop sectioned cam block 134 is provided with a transverse recess 180 having a concave wall surface for general mating engagement with the end cylindrical member 90 of the fixed trapeze frame member. Thus, the cam block 130 is provided a concave surface permitting the cam block to have limited rotation on the exterior surface of end member 90 as the biased cam rollers 170 and cam block 130 moves from locked to unlocked position.

In general operation of the ski binding described above, it will be noted that the releasable lock means may be pivoted as shown to the left of FIG. 5 to permit ready access and observance of the positioning of the toe of a ski boot into the cradle means 30. The ski boot may be placed in the cradle means and the heel clamp, which has been previously adjusted to proper position, locks the ski boot in the cradle means with the toe coil spring 52 and the heel clamp 58 retaining the ski boot within the cradle means. The cradle means has been previously assembled with the fixed trapeze means by lowering the pivot pin 50 into its operative position between the pivot support end members 90 and 102 of the fixed trapeze means. Lock means 32 may be swung from the phantom open position shown in FIG. 5 rearwardly toward the instep of the boot and clamp 112 pressed downwardly into its locked position.

Lock means 32 is in the unlocked position shown in FIG. 5 where the cam surfaces 162 of the cam block are in surface engagement with the cam rollers 170. To lock the lock means and to lock the cradle pivot pin 50 in relation to the trapeze means, downward pressure is applied to clamp member 112. As downward pressure is applied to member 112, housing 110 pivots about pin 126 and cam block 130 is turned relative to end member 90 to cause block 130 to move counter clockwise about shaft 132 as viewed in FIG. 5. Cam rollers 170 swing downwardly about shaft 176 until rollers 170 pass over cam lobe surfaces 164 and then swing slightly upwardly to engage cam surfaces 160 in the locked position shown in FIG. 3. During such swinging movement of rollers 170, the rollers are biased in pressure engagement with cam surfaces 160, 162 and 164 by the spring 146 which yields under compression. The recessed central portion having recessed surfaces 136, 138 provide space for the spring cap 142 to move during such movement of the rollers 170.

It will be apparent that by adjustment of the position of the set screw 152, the compression of the coil spring 146 may be varied to provide a selected release pressure at the cam rollers 170. Further, the adjustment of the spring pressure determines the ease by which the cam block turns relative to the cylindrical surface of the end member 90. In locked position, it will be apparent that the downward turned end 114 of the clamp 112 covers pivot pin 50 of the cradle means and securely holds the pin in its desired position between pivot support end members 90 and 102.

When it is desired to release the cradle means from the fixed trapeze means, end 114 of the lock clamp member 112 is lifted upwardly to release the pivot pin 50 from its previous seated position between members 90 and 102. It will be understood that the releasable lock means described above is exemplary only and that other types of releasable lock means may be employed.

The cantilevered pivot pin support of the fixed frame structure which locates the pivot pin 50 on the cradle means above the ball of a foot in a ski boot provides advantages which will be further better understood by a consideration of FIGS. 10 and 11.

FIG. 10 schematically shows a conventional ski mountaineering binding with a rigid soled boot in which the sole of the boot is illustrated as supported by the fulcrum point $F_c$ at the front and by the binding sole plate (typical) at H at the rear.

A static situation with the boot supported at $F_c$ and H and the skier's total weight at $W_c$ would show approximately $\frac{2}{3}$ of the total weight at $F_c$ and $\frac{1}{3}$ of the weight at Wh. This weight distribution occurs because the horizontal distance between the fulcrum $F_c$ and the total weight on the ball of the foot at $W_c$ is approximately $\frac{1}{2}$ the distance between the total weight location at $W_c$ and the weight at the boot heel. When a skier moves forward and lifts the heel off the ski with his weight at $W_c$, the approximately $\frac{1}{3}$ of the total weight that registers at H must be overcome by an equal force both at the heel cup and the front upper section of the boot A—A. Since the upper material of the boot is flexible, warm socks compress, and the foot itself is flexible, overcoming the downward force at the heel results in movement of the skier's heel up and down in relation to the heel cup, resulting in friction and blisters.

FIG. 11 schematically illustrates the weight distribution of the ski binding of the present invention. In FIG. it will be noted that the fulcrum $F_E$ is located above and slightly forwardly of the location of the weight of the skier and gear on the ball of the foot which is located at WE. The weight on the heel is indicated at WF. It will be noted in FIG. 11 that the horizontal distance between the fulcrum $F_E$ and the total weight WF at the ball of the foot is approximately 1/6 to 1/7 times the distance between the weight force $W_E$ at the ball of the foot to the boot heel $W_F$. As a result, the fulcrum $F_E$ will bear approximately 30% more of the static weight of the skier and his gear as compared to the conventional ski binding. As the result, movement of the foot and the force required to lift the heel of the boot off the ski for movement is considerably less. In this respect, since the fulcrum is located above the boot forward foot portion, the toe of the boot is moved slightly downwardly to clear the top surface of the ski and the path followed by the heel of the boot commences with a rearward upward arc until the heel of the boot reaches the level of the fulcrum. Movement of the skier's heel against the boot heel cup is significantly diminished and the binding of this invention provides more comfort to the skier. Further, the rolling motion of the foot is more smooth, which results in more efficiency and diminishes calf muscle strain. This advantage becomes progressively more important as the loads carried by the skier increase and the steepness of climbing increases.

The relationship between the location of the fulcrum above and slightly forwardly of the location of the ball of the foot and the top of the ski surface must be such that when the ski boot on its cradle means is moved about the fulcrum, the toe of the boot has clearance with the top of the ski to permit moving of the boot about a full arc required by the motions in propelling the skier forwardly on the ski. If the height of the fulcrum is too low, then the toe of the boot will not be provided sufficient clearance to permit movement about the fulcrum. If the fulcrum is displaced forwardly of the location shown in FIG. 11, then it will be apparent that the weight distribution advantages of the present invention will be diminished. If the location of the fulcrum is moved rearwardly to a position over the ball of the foot, then the weight distribution becomes closer to the location of the ball of the foot, but the necessary clearance of the toe of the boot with the top of the ski surface becomes more critical. If the height of the fulcrum is too high, then such height of the fulcrum may reduce the stability of the ski binding during skiing. The front configuration of the ski boot must also be taken into consideration in order to permit the desired movement of the ski boot about the fulcrum. The description of the location of the fulcrum as above set forth has provided an effective location of the pivotal axis which has facilitated skiing with the ski binding above described.

It will be understood that various changes may be made in the trapeze-like frame structure which provides the pivot support means and that various changes may also be made in the form and shape of the cradle means which supports and carries the boot. Various other changes may be made in the ski binding described above and all such changes and modifications coming within the spirit of this invention and within the scope of the appended claims are embraced thereby.

I claim:

1. In a ski binding for use with a ski boot and a ski member, the combination of:

means including a frame structure having a bottom portion adapted to be fixed to a ski member, and an end portion extending upwardly and rearwardly away from said bottom portion in spaced relation to said ski member, said frame structure forming a recessed area which is adapted to receive a toe portion of a boot, said end portion carrying pivot support means;

a boot carrying structure including pivot means and pin means cooperable with said pivot support means and clamp means adapted to engage a heel portion of the boot for securing the boot to said boot carrying structure;

said pivot means, pin means, and pivot support means providing a pivot axis located above said ski boot rearwardly of the toe portion of said ski boot and forwardly of a ball of a skier's foot in the ski boot.

2. A ski binding as claimed in claim 1 including resilient means carried by said boot carrying structure adapted to restrain forward movement of the toe of a boot.

3. A binding as claimed in claim 1 wherein said boot carrying structure includes means providing a platform for support of the sole of a boot.

4. A binding as claimed in claim 1 including releasable lock means carried on said end portion of the frame structure and cooperable with the pivot pin means carried by said boot carrying structure.

5. A binding as claimed in claim 1 wherein said pivot pin support means on said frame structure includes longitudinally parallel transverse members for partial reception therebetween of said pivot pin means.

6. A binding as claimed in claim 5 wherein said pivot pin means includes a rotatable cylindrical sleeve adapted to longitudinally and tangentially contact said transverse members of said pivotal support means.

7. A binding as claimed in claim 4 wherein said releasable lock means includes cam block means having a partially cylindrical longitudinally extending recess for cooperable engagement with one of said transverse members.

8. A binding as claimed in claim 7 wherein said cam block means includes a central portion having a recess with angularly disposed central flat surfaces, and cam surfaces outwardly of the central portion.

9. A binding as claimed in claim 8 wherein said releasable lock means includes a housing pivotally mounted from said frame structure;

said housing providing a pivotal mounting for said cap;

said pivotal mounting of said cap including links pivotally connected with said cap and cam rollers engageable with said cam surfaces outwardly of said central flat surfaces.

10. A ski binding as claimed in claim 1, wherein:

said boot carrying structure includes an elongated cradle means for receiving a ski boot having a toe portion and a heel portion;

said pivot means being located proximate to a transverse vertical plane passing through the ball of a foot in the toe portion of the boot, so that the distribution of the load between the pivot means and the heel maximizes loading at the pivot means and reduces loading at the heel to minimize relevant movement of the skier's heel relative to the boot heel.

11. A ski binding as claimed in claim 10, including:

means carried by said pivot support means for releasing said pivot pin means.

12. A ski binding as claimed in claim 10, wherein the space between said pivot means and the opposed surface of said cradle means permits pivotal movement of the toe of the boot downwardly toward the top surface of the ski.

* * * * *